US006598330B2

(12) United States Patent
Garrett et al.

(10) Patent No.: US 6,598,330 B2
(45) Date of Patent: Jul. 29, 2003

(54) SLING ATTACHMENT HARDWARE FOR FIREARMS

(76) Inventors: Robert Hudson Garrett, 8191 Barnwood Rd., Manassas, VA (US) 20111; Sandy Alexander Garrett, Jr., 9668 Manassas Forge Dr., Manassas, VA (US) 20111

( * ) Notice: Subject to any disclaimer, the term of this patent is extended or adjusted under 35 U.S.C. 154(b) by 0 days.

(21) Appl. No.: 09/950,994

(22) Filed: Sep. 13, 2001

(65) Prior Publication Data

US 2003/0110675 A1 Jun. 19, 2003

Related U.S. Application Data

(60) Provisional application No. 60/233,062, filed on Sep. 14, 2000.

(51) Int. Cl.[7] ..... F41C 23/02

(52) U.S. Cl. ..... 42/85; 24/2.5; 24/20 R; 224/150; 292/256.6

(58) Field of Search ..... 42/85; 54/69; 24/2.5, 24/20 S, 20 R, 265 R, 704.2, 21, 69 AT, 457, 584.1, 16 R, DIG. 29, DIG. 31; 224/150; 403/202; 292/256.6, 256.61, 305

(56) References Cited

U.S. PATENT DOCUMENTS

| | | | | | |
|---|---|---|---|---|---|
| 330,426 | A | * | 11/1885 | Rohrer et al. | 54/51 |
| 1,366,715 | A | * | 1/1921 | Burton | 24/2.5 |
| 2,913,960 | A | * | 11/1959 | Harvey et al. | 42/85 |
| 3,376,004 | A | * | 4/1968 | Goldman | 24/16 R |
| 3,651,544 | A | * | 3/1972 | Soma | 24/16 R |
| 4,470,216 | A | * | 9/1984 | Harris | 42/85 |
| 4,571,872 | A | | 2/1986 | Johnson | |
| 4,823,998 | A | | 4/1989 | Johnson | |
| 5,067,267 | A | | 11/1991 | Ives | |
| 5,074,069 | A | | 12/1991 | Shire | |
| 5,092,505 | A | | 3/1992 | Olschlager | |
| 5,501,025 | A | | 3/1996 | Johnson | |
| 5,613,316 | A | | 3/1997 | Hightower | |
| 5,810,219 | A | | 9/1998 | Rosenfield | |
| 5,848,491 | A | | 12/1998 | Biemont | |
| 5,881,487 | A | | 3/1999 | Chalker | |
| 5,971,239 | A | * | 10/1999 | Marable | 224/150 |

FOREIGN PATENT DOCUMENTS

| | | | | |
|---|---|---|---|---|
| FR | 1 040 947 | * | 10/1953 | 42/85 |

* cited by examiner

*Primary Examiner*—Michael J. Carone
*Assistant Examiner*—Gabriel S. Sukman

(57) ABSTRACT

The present invention relates to hardware used to secure slings to firearms. In particular, to hardware used to secure slings to firearms like that of the M16A2 and M4 Carbine that are fitted with a Picatinny type rail and collapsible buttstock. A wedge/yoke assembly is used to secure an end of a sling to the firearm on a rail and a rotational ring assembly is used to secure an end of a sling to the extension tube of the lower receiver. Both assemblies are designed to be installed quickly without the use of tools and without modification to the firearm. This hardware provides for ambidextrous attachment of a tactical sling to the firearm giving the user a "hands free" capability and allowing for engagement of targets when firing from a "weak hand" posture.

5 Claims, 11 Drawing Sheets

SLING ATTACHMENT HARDWARE FOR FIREARMS

This application claims the benefit of U. S. Provisional application No. 60/233,062, filed Sep. 14, 2000.

BACKGROUND OF THE INVENTION

The present invention relates to the field of hardware used to secure slings to firearms.

1. Field of the Invention

The use of hardware to attach slings to firearms is known. Most firearms are provided with a stud, loop or swivel to attach a conventional sling to the firearm. Conventional slings are used primarily to transport the firearm, over the shoulder, when the firearm is not in use. Some slings are equipped with features that enable the user to adjust the sling so that it can be used to steady the firearm when firing from various positions such as the prone and sitting position.

With the recent trend towards armed conflict in urban areas, special slings have been developed that enable the user to engage targets with the firearm and suspend the firearm in an advantageous position, waist level for instance, when the firearm is released. The use of these tactical slings, allows the firearm to be carried comfortably for extended periods of time while making access to the firearm instantaneous should the firearm be needed. Additionally these tactical slings allow the user to release the weapon when one or both hands are needed to perform a task without a change in the general orientation of the muzzle of the firearm. These slings generally position the firearm in the front of the user.

The most popular tactical slings such as the Heckler and Koch (H&K) Ambidextrous Multipurpose Carrying Sling can be configured several different ways for tactical use and transport. This sling uses "snap link" type hooks to attach the sling to the firearm. H&K firearms are manufactured with fixed attachment points designed to accept the hooks of the sling. Some models incorporate the use of modified take-down pins to allow ambidextrous attachment of the tactical sling to the firearm. These pins have a loop at one end and a screw/nut combination at the other. The attachment points for the sling on these weapons are on the receiver placing them close to the torso of the user while keeping the ends of the weapon clear. The sling does not interfere with the users arms increasing his mobility and dexterity.

Some firearms such as the M4 Carbine have incorporated a sling loop into the top of the collapsible buttstock to allow soldiers to configure their conventional slings for tactical "top" carry. The attachment of the sling to the front swivel, located under the front sight, did not allow for a proper "top" carry and a device was introduced that placed the sling swivel on the side of the weapon attached directly to the barrel. This unit is held in place with a plate and two roll pins and can be positioned on either side to accommodate left or right handed shooters. This tactical front swivel device still has several disadvantages when used with a newly adopted Rail Adapter System (RAS) being used by the military. The RAS allows soldiers to attach lights, range finders, night scopes and other accessories to the weapon. The location of the tactical front swivel device negates the use of one rail of the RAS because the sling blocks the device mounted on that side of the weapon when in use.

Another disadvantage of this tactical sling configuration is that the mounting points at the extreme front and rear of the weapon are not desirable when operating in a Close Quarters Battle (CQB) environment such as rooms and hallways. The sling gets in the way of the arms of the user reducing his mobility and dexterity. The balance point of the sling also changes with the location of the collapsible buttstock requiring readjustment of the slung weapon. The conventional sling adapted to this configuration also lacks a means to quickly release and attach it to the weapon.

2. Discussion of Prior Art

Several attempts have been made to adapt the tactical sling to firearms such as the M16A2 and M4 Carbine. Most require the use of tools to install and require the weapon to be disassembled past the operator level.

A modified M4 receiver end plate (Ambiegg) by GG&G has two large eyelets, one on each side, to accept the hook of a tactical sling. The location of these eyelets on the lower portion of the receiver end plate and below the center of balance make the weapon unbalanced. A sling attached to the eyelet on the ejection port side of the weapon will interfere with the operation of the forward assist of the M4 by the left handed user. Disassembly of the weapon past the user level and the use of special tools are required to install this modified plate. This modified plate is not truly ambidextrous as the sling must be unhooked and reattached to accommodate a left or right handed user.

Some devices such as the Knight's Armaments MWS Front Sight Tower Sling Adapter use a screw/plate configuration to affix a swivel to the front sight of the M4 carbine. This device requires the use of tools to install and places the sling forward where it can interfere with accessories mounted to an RAS. There is also the possibility of a loosening of the front sight assembly which is fixed to the barrel with taper pins. If a weapon is fitted with a "flip-up" front sight, this device cannot be used. The "flip-up" front sight is desirable when using optics mounted to the upper receiver of the weapon or RAS.

Another device by Knight's uses a traditional Weaver type base/plate/screw combination to affix the swivel to an RAS rail. This device allows the user to place the mounting point behind the accessories mounted on the rail but requires tools to install/remove and the screw of the assembly can vibrate loose during use.

Yet another device by Dennis S. Chalker utilizes three "D" rings and a nylon strap to secure a sling to the receiver extension of the M4 and similar weapons. This strap device does not require tools to install and can be configured to accommodate both right and left handed shooters. This assembly must be taped or otherwise secured to the receiver extension, however, to keep the mounting point from rotating to the top of the extension and to keep it from sliding back along the length of the extension. Due to the "cinch" configuration of the securing "D" rings, if the assembly rotates to the top of the extension, it will interfere with the operation of the charging handle of the weapon.

It should be clear to the reader that tactical sling hardware should be capable of being easily installed by the user-without the use of tools. Once installed it should provide for secure mounting without screws that can loosen during use. The mounting points provided by the sling hardware should allow proper balance of the slung weapon. The mounting points provided by the hardware should be positioned on the weapon in such a way as to clear the ends of the weapon for free use in CQB environments. It should also be clear to the reader that the mounting points provided by the sling hardware should not interfere with any of the controls or accessories of the weapon such as the charging handle. Further, it should be clear to the reader that the sling mounting hardware should work with the widest range of tactical slings available.

Objects and Advantages

One object of our invention is to provide sling attachment hardware that is readily adaptable to a wide range of "NATO" firearms currently fitted with an RAS such as the M4 Carbine, Modular Weapon System and CQBW. The preferred embodiment of our invention will be manufactured to military specifications providing durable, balanced mounting points on the weapon. The preferred embodiment will also be easily installed by the user without the use of tools and will require no disassembly of the weapon past the user level. This will enable the user to easily configure his weapon for a variety of missions. The hardware will be ambidextrous and/or reversible by design to accommodate either left or right handed users. A further object of our invention is to provide sling attachment hardware that provides mounting points that will not interfere with the controls or accessories of the weapon. The mounting points provided by our invention will be oriented closer to the torso of the user and closer to the receiver to free-up the ends of the weapon for unhindered use in CQB environments.

There is another disadvantage of the current buttstock attachment point of the M4 carbine not previously discussed. A new buttstock with an ergonomically correct cheekpiece is being considered by the military. This buttstock will also house spare batteries in cavities created by the addition of the angled cheekpieces. The user must remove the buttstock to access the spare battery compartments. The action of accessing the spare battery compartments becomes problematic if this is attempted while the weapon is slung. It is a further object of our invention to provide sling mounting hardware that allows for mounting points that are not attached to the buttstock. This will allow the user to freely access the spare battery compartments of the improved buttstock with the weapon slung.

Further objects and advantages of our invention will become apparent from a consideration of the drawings and ensuing description.

BRIEF DESCRIPTION OF THE DRAWINGS

The present invention will now be described further by way of example, with reference to the accompanying drawings, in which.

REFERENCE NUMERALS IN DRAWINGS

| | |
|---|---|
| 2 | base |
| 3 | open end |
| 4 | wedge |
| 5 | slope edge |
| 6 | split ring |
| 7 | orifice |
| 8 | upper ring half |
| 9a | right upper leg |
| 9b | left upper leg |
| 10 | eyelet |
| 11a | right lower leg |
| 11b | left lower leg |
| 12 | lower ring half |
| 13 | bottom |
| 14 | spring clip |
| 15a | upper channel |
| 15b | lower channel |
| 16 | castle nut |
| 17 | leading end |
| 18 | stop shelf |
| 19 | small end of slot |
| 20 | receiver extension |
| 21 | hole |
| 22 | buttstock |
| 23 | dovetail |
| 24 | RAS (rail system) |
| 25 | large end of slot |
| 26 | rail |
| 27 | standard recess |
| 28 | M4 Carbine |
| 29 | standard rib |

-continued

| | |
|---|---|
| 30 | receiver end plate |
| 31 | hook |
| 32 | cam lever |
| 33 | sling |
| 34 | end rib |
| 35 | latch |
| 36 | locking spacer |
| 37 | stud |
| 38 | locking rib |
| 39 | sloping slot |
| 40 | charging handle |

Description of the Preferred Embodiment—FIGS. 1–8

Figure 1:
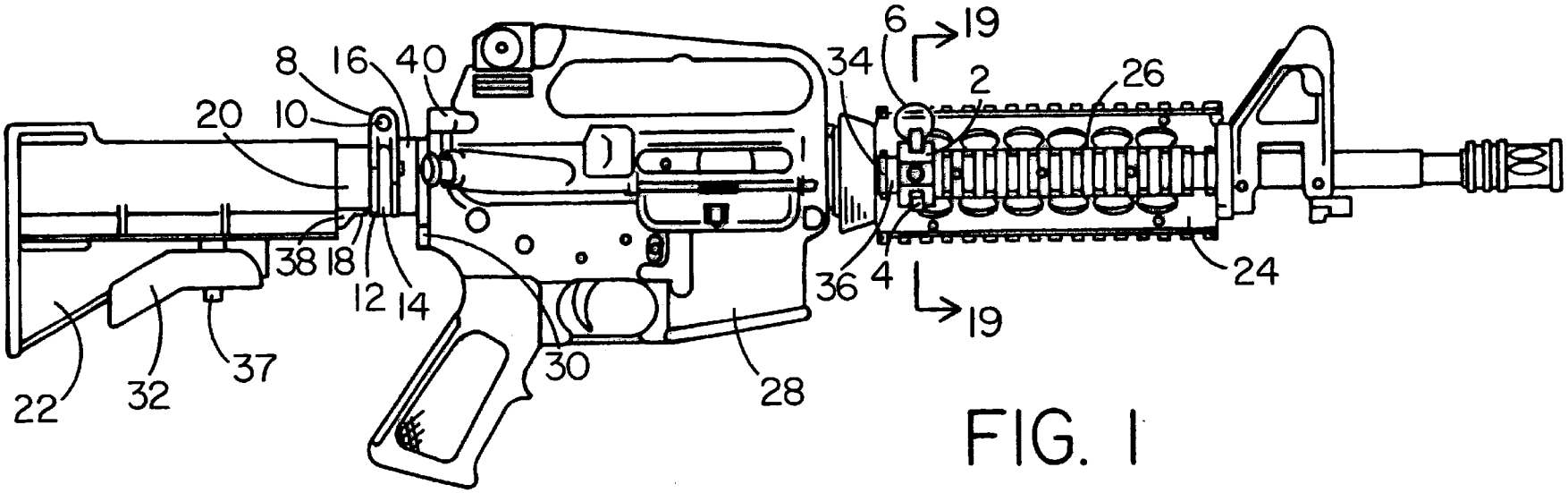
FIG. 1 is a side view of the M4 Carbine showing the preferred locations of the preferred embodiments.

FIG. 1 shows the side view of an M4 Carbine 28 fitted with a RAS 24 consisting of four each of a rail 26. Each rail 26 has an end rib 34 and a locking spacer 36 at either end. A base 2 of the preferred embodiment (front mount) is shown mounted on rail 26 with a wedge 4 locked in its operational position and an optional split ring 6 attached to accept the hook of a tactical sling.

The preferred embodiment (rear mount) is shown around a receiver extension 20. The preferred embodiment (rear mount) consists of an upper ring half 8 interlocked with a lower ring half 12 with an optional spring clip 14 affixed. Upper ring half 8 is provided with an eyelet 10 to accept the hook of a tactical sling. The preferred embodiment (rear mount) is stationed and rotational between a stop shelf 18 of receiver extension 20 and a castle nut 16 which is used to secure both receiver extension 20 and a receiver end plate 30 to M4 Carbine 28. A cam lever 32 is pulled away from receiver extension 20 until a stud 37 is disengaged from a locking rib 38 so that a buttstock 22 can be removed from receiver extension 20.

Figure 2:
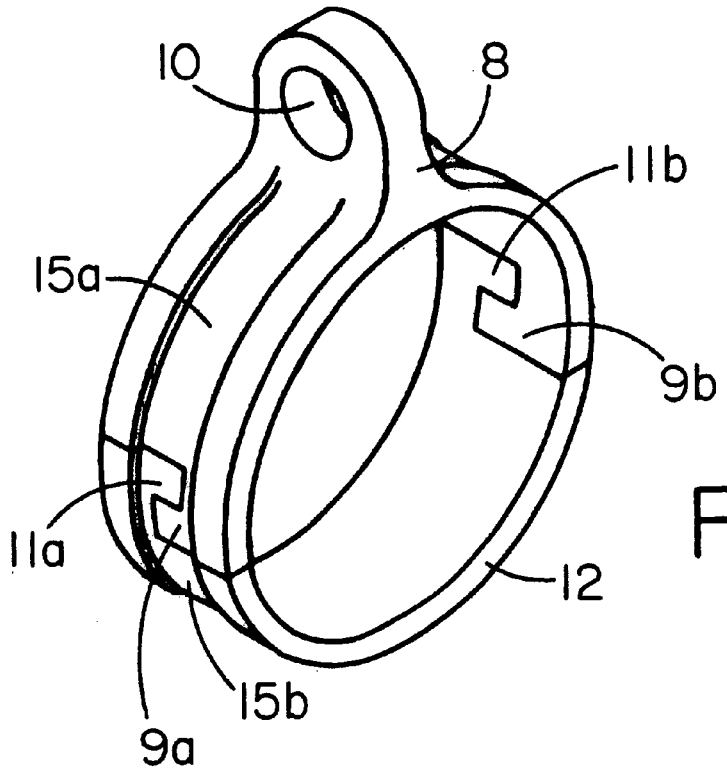
FIG. 2 is a perspective view of the preferred embodiment (rear mount)

FIG. 2 shows the preferred embodiment where upper ring half 8 is connected to lower ring half 12 by means of a mating of a left upper leg 9*b* and a right upper leg 9a with a left lower leg 11*b* and a right lower leg 11*a* respectively. When upper ring half 8 and lower ring half 12 are joined an upper channel 15*a* and a lower channel 15*b* coincide to provide a seat for spring clip 14. Spring clip 14 is attached to the preferred embodiment by forcing an open end 3 of spring clip 14 over lower ring half 12 while centered in lower channel 15*b*. Spring clip 14 is pushed in the direction of eyelet 10 until it snaps into the channel formed by upper channel 15*a* and lower channel 15*b*. When assembled over a cylinder the preferred embodiment with optional spring clip 14 forms a concentric ring assembly capable of free rotation. Upper ring half 8 and lower ring half 12 are concentrically joined until spring clip 14 is removed. Force exerted on eyelet 10 will not alter the concentricity of the assembly. The width of upper channel 15*a* and lower channel 15*b* are identical and sufficient to allow for the width of spring clip 14. The width of spring clip 14 should allow for its complete seating within upper channel 15*a* and lower channel 15*b*.

Figure 3:
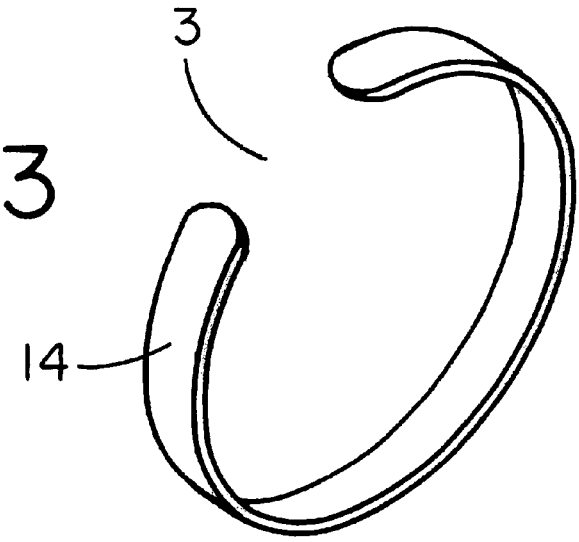
FIG. 3 is a perspective view of the optional securing spring clip for the preferred embodiment (rear mount)

FIG. 3 shows spring clip 14 with open end 3.

Figure 4:
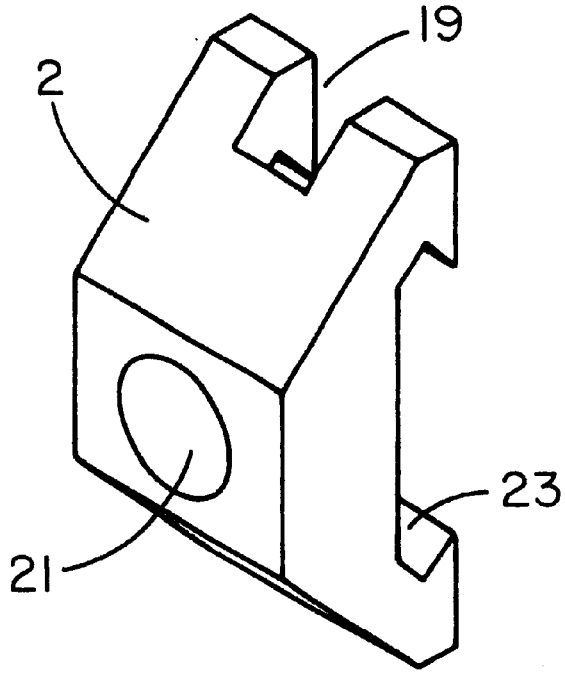
FIG. 4 is a perspective view showing the preferred embodiment (front mount) base.

FIG. 4 shows the preferred embodiment (front mount) consisting of base 2 with a dovetail 23 running perpendicular to a small end of slot 19 and a hole 21 for weight reduction.

Figure 5:
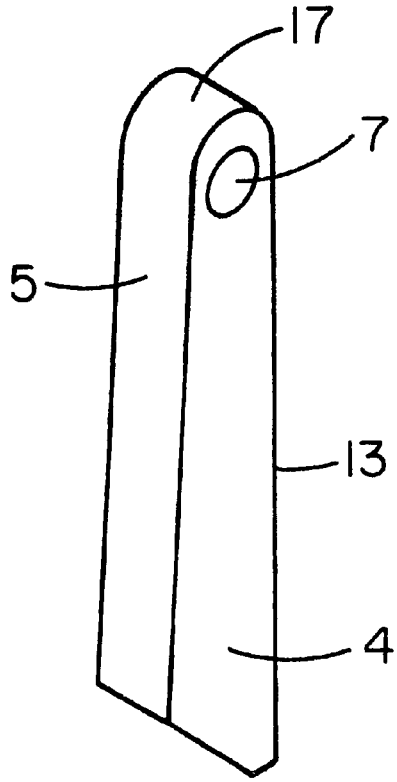
FIG. 5 is a perspective view showing the preferred embodiment (front mount) wedge.

FIG. 5 shows wedge 4 of the preferred embodiment having a slope edge 5, a bottom 13 and a leading end 17. Leading end 17 has an orifice 7 for accepting the hook of a sling or other interfaces (optional).

Figure 6:
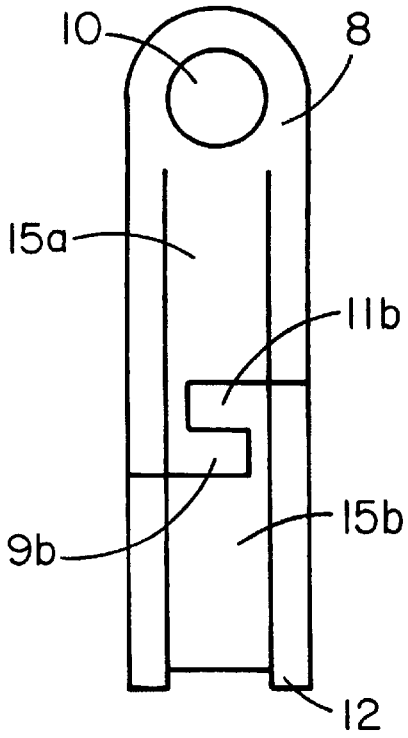
FIG. 6 is a left side view of the preferred embodiment (rear mount) assembled.

FIG. 6 shows upper ring half 8 and lower ring half 12 engaged to form a concentric assembly.

Figure 7:
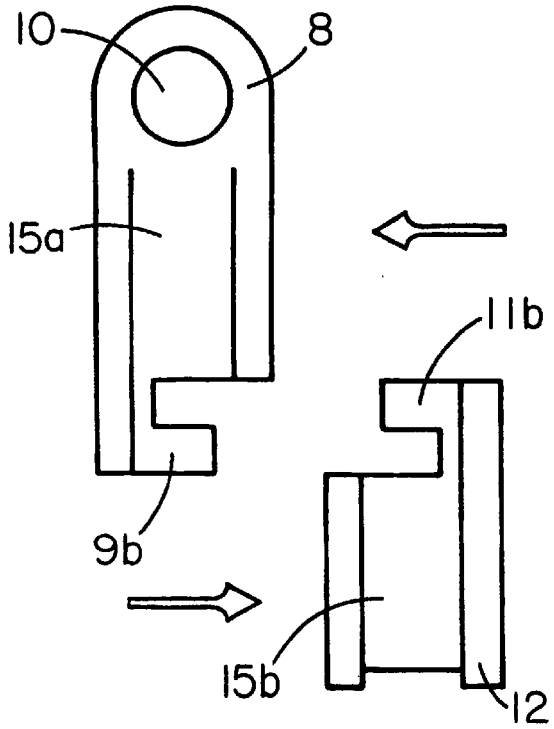
FIG. 7 is a left side view of the preferred embodiment (rear mount) disassembled.

FIG. 7 shows upper ring half 8 and lower ring half 12 disengaged.

Figure 8:
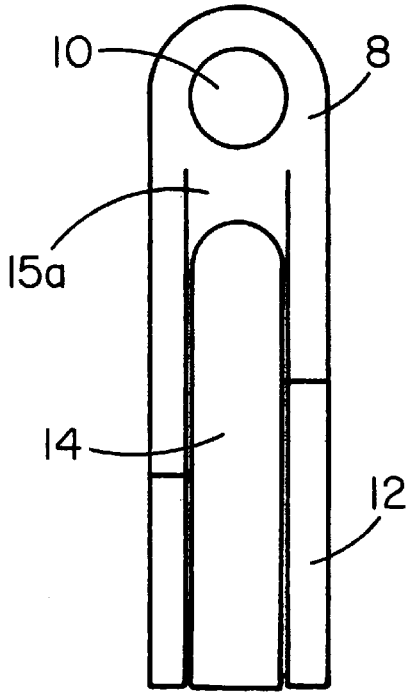
FIG. 8 is a left side view of the preferred embodiment (rear mount) assembled with optional securing spring clip in place.

FIG. 8 shows upper ring half 8 and lower ring half 12 engaged with optional spring clip 14 installed forming the preferred embodiment (rear mount).

Description of the Preferred Embodiment—Assembly of the Rear Mount FIGS. 9–13

Figure 9:
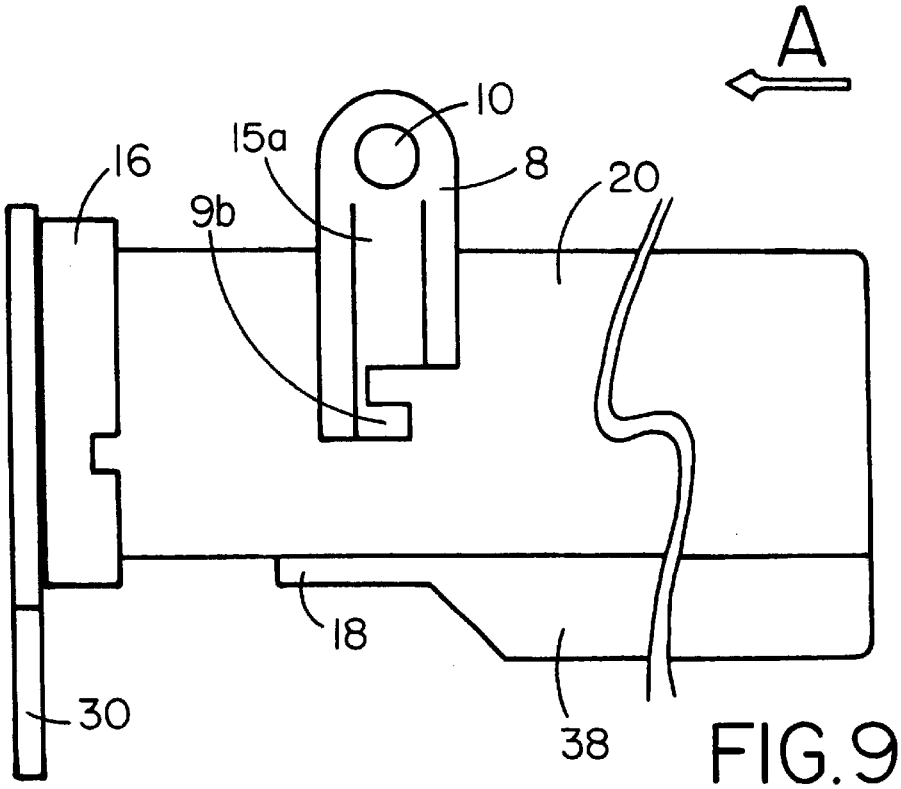
FIG. 9 is a left side view of the receiver extension of the M4 Carbine showing the preferred embodiment (rear mount) upper portion being installed (Step 1)

FIG. 9 shows upper ring half 8 straddling receiver extension 20. This is accomplished by sliding upper ring half 8 over the end of receiver extension 20 in the direction of arrow "A" with left upper leg 9*b* facing away from castle nut 16. Eyelet 10 must be oriented in the direction opposite that of locking rib 38. Upper ring half 8 is moved in the direction of arrow "A" until it abuts castle nut 16. Once, upper ring 8 abuts castle nut 16, eyelet 10 is rotated in the direction of locking rib 38. In this position upper ring 8 is stationed between stop shelf 18 and castle nut 16 with its longitudinal movement limited.

Figure 10:
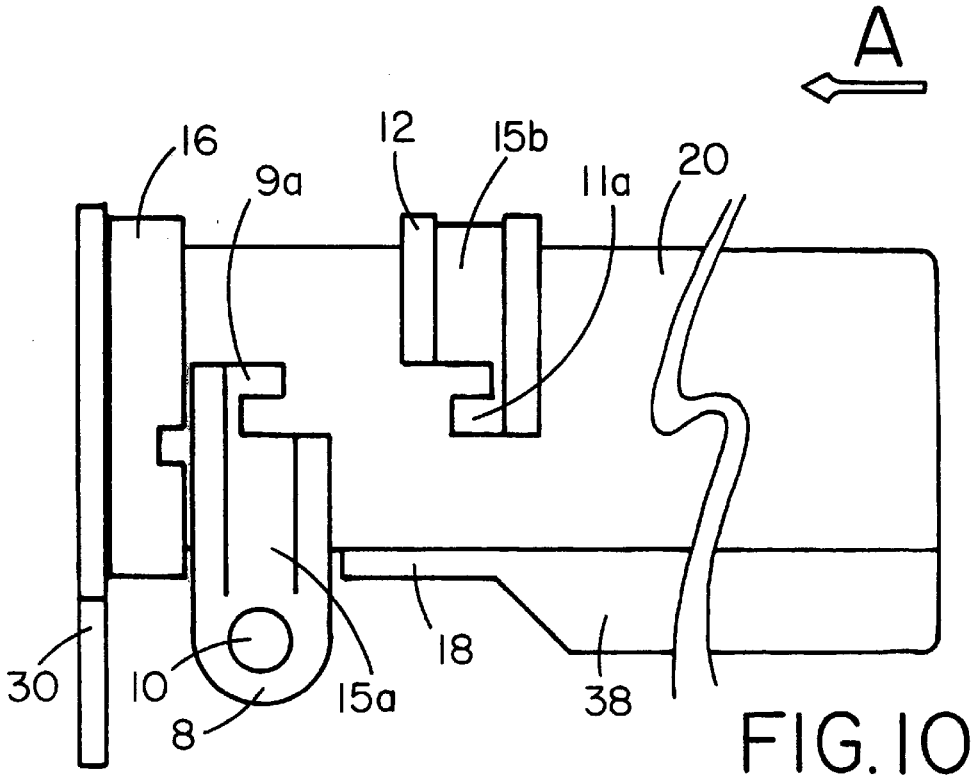
FIG. 10 is a left side view of the receiver extension of the M4 Carbine showing the preferred embodiment (rear mount) lower portion being installed (Step 2)

FIG. 10 shows upper ring half 8 stationed between castle nut 16 and stop shelf 18. Eyelet 10 is in alignment with locking rib 38. Lower ring half 12 is placed over the end of receiver extension 20 and moved in the direction of arrow "A" with right lower leg 11*a* facing castle nut 16. Lower ring half 12 is moved in the direction of arrow "A" until it contacts and mates with upper ring half 8.

Figure 11:
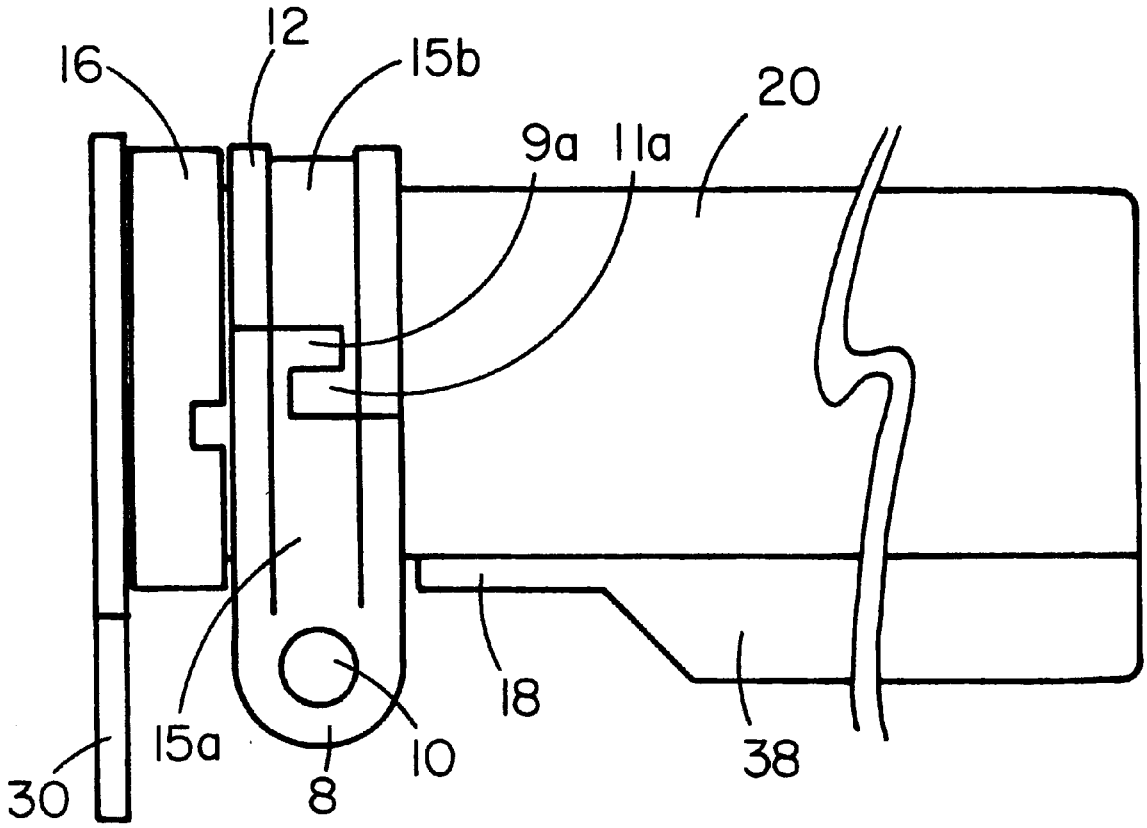
FIG. 11 is a left side view of the receiver extension of the M4 Carbine showing the preferred embodiment (rear mount) lower portion and upper portion joined (Step 3)

FIG. 11 shows upper ring half 8 and lower ring half 12 mated. Once mated upper ring half 8 and lower ring half 12 are rotated until eyelet 10 is oriented in the direction opposite that of locking rib 38. This is the operational orientation of eyelet 10. When the weapon is shouldered for firing, the sling attached to eyelet 10 pulls eyelet 10 towards the user ensuring that eyelet 10 does not interfere with controls such as charging handle 40 of FIG. 1 (slung weapon). If the sling is attached to the weapon but not the user, the weight of the attached sling and gravity pulls eyelet 10 to a position that is in alignment with that of locking rib 38 ensuring unhindered access to controls such as the charging handle 40 of FIG. 1.

Figure 12:
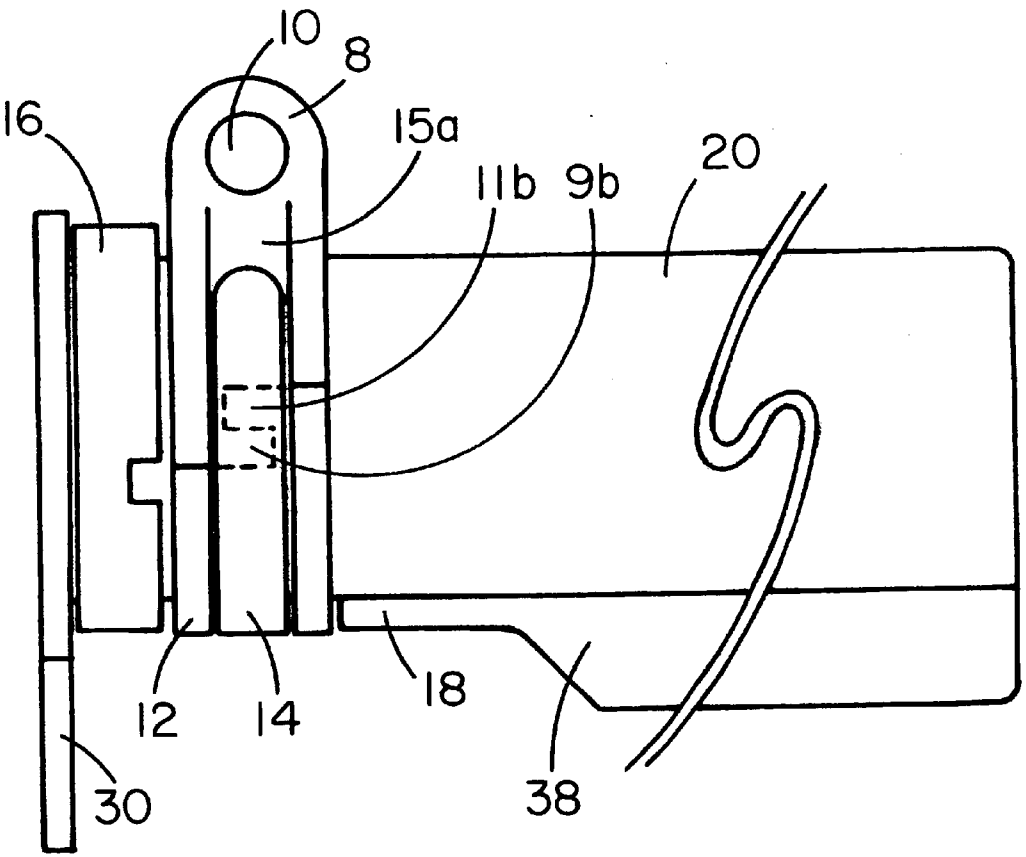
FIG. 12 is a left side view of the receiver extension of the M4 Carbine showing the preferred embodiment (rear mount) upper and lower portions joined with securing spring clip installed in the operational position (Step 4)

FIG. 12 shows upper ring half 8 and lower ring half 12 mated with eyelet 10 in its operational orientation with spring clip 14 attached. The preferred embodiment (rear mount) is rotational, provides for ambidextrous access to eyelet 10 and is stationed between castle nut 16 and stop shelf 18. With eyelet 10 in its operational orientation, lower ring half 12 is captured between castle nut 16 and stop shelf 18. The orientation of left upper leg 9*b* and left lower leg 11*b* (right upper leg 9*a* and right lower leg 11*a*—not shown) enables lower ring half 12 to capture upper ring half 8 and maintain a concentric assembly without spring clip 14 installed. Spring clip 14 ensures the assembly's integrity when eyelet 10 is not in its operational orientation.

Figure 13:
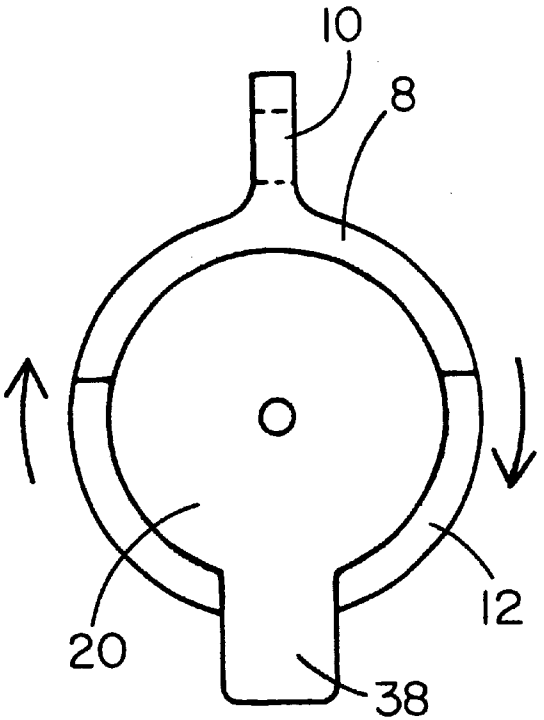
FIG. 13 is an end view of the receiver extension of the M4 Carbine showing the preferred embodiment (rear mount) installed.

FIG. 13 shows the rotational capability of upper ring half 8 and lower ring half 12 around receiver extension 20 with eyelet 10 in its operational orientation opposite locking rib 38.

Description of the Preferred Embodiment—Assembly of the Forward Mount FIGS. 14–20

Figure 14:
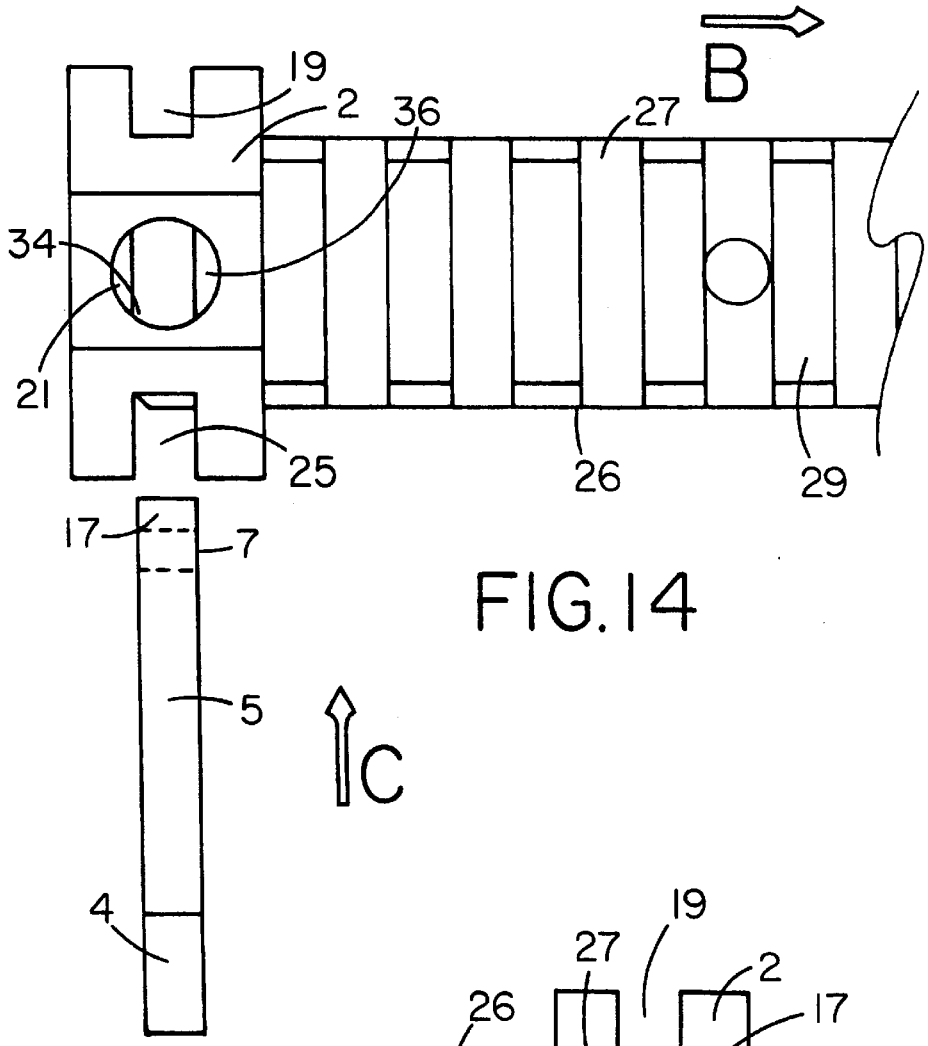
FIG. 14 is a side view of a rail of the RAS of the M4 Carbine showing the preferred embodiment (front mount) being installed (Step 1)

FIG. 14 shows base 2 straddling end rib 34 of rail 26. The configuration of locking spacer 36 allows base 2 to straddle end rib 34. It is also possible to simply override end rib 34 with base 2 depending upon the location of rail 26. Base 2 is moved in the direction of arrow "B" until small end of slot 19 and large end of slot 25 line up with one of several standard recess 27. Hole 21 of base 2 helps the user align base 2 with standard recess 27. Wedge 4 is shown in alignment with but out of engagement with large end of slot 25 of base 2.

Figure 15:
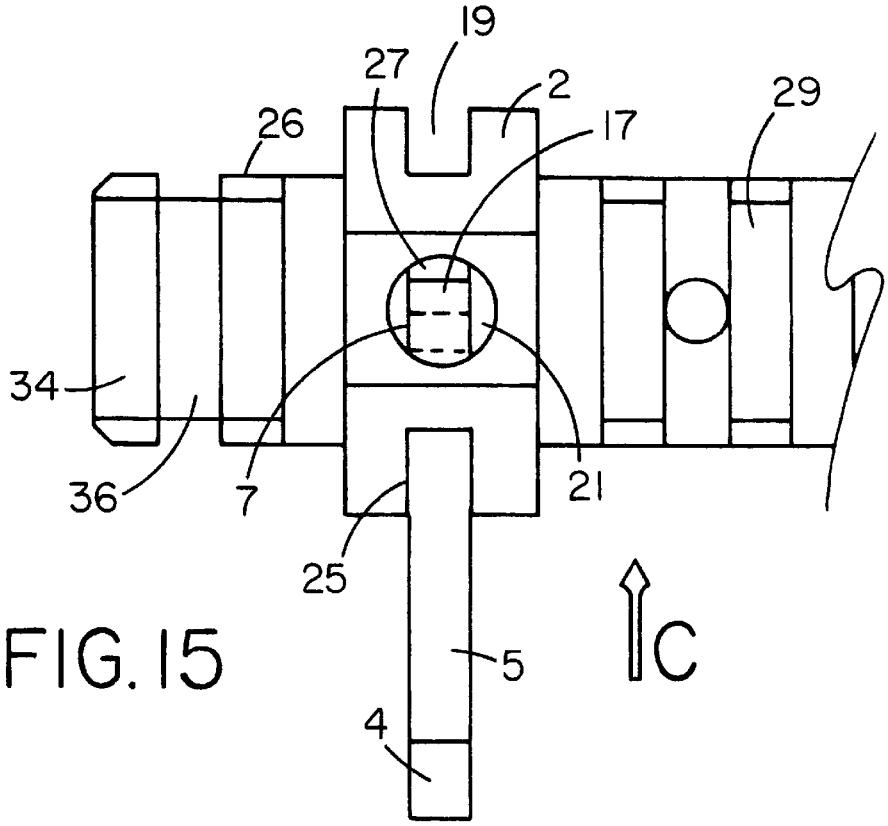
FIG. 15 is a side view of a rail of the RAS of the M4 Carbine showing the preferred embodiment (front mount) being installed, base located and wedge started (Step 2)

FIG. 15 shows base 2 aligned with a standard recess 27 of rail 26. A leading end 17 of wedge 4 has engaged large end of slot 25 with a slope edge 5 of wedge 4 facing away from rail 26. Wedge 4 is moved in the direction of arrow "C" until it can be moved no further. This action securely fixes base 2 to rail 26 limiting any longitudinal movement.

Figure 16:
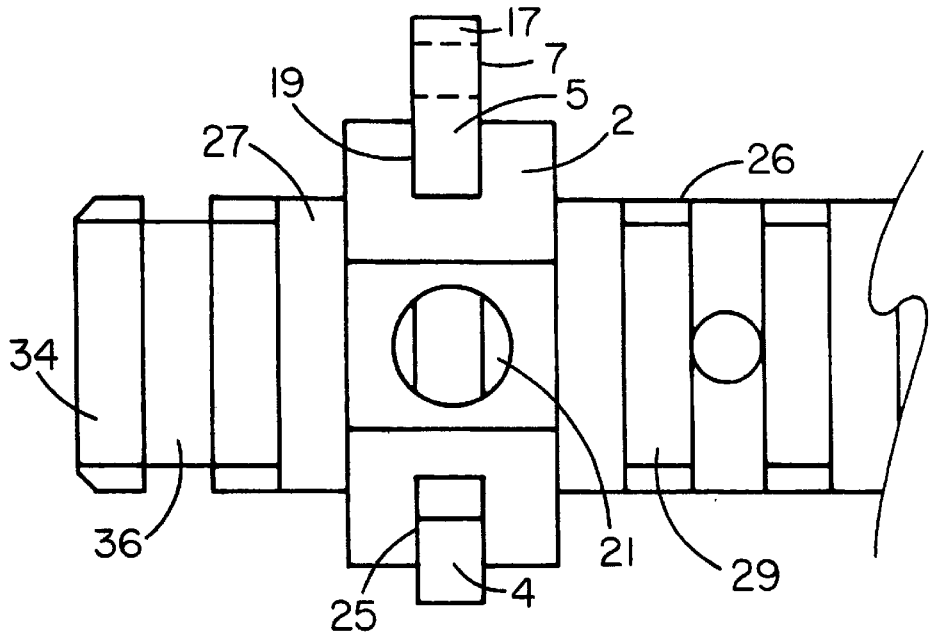
FIG. 16 is a side view of a rail of the RAS of the M4 Carbine showing the preferred embodiment (front mount) installed, base fixed and wedge locked (Step 3)

FIG. 16 shows the locked positioning of base 2 with wedge 4 in its operational orientation. An orifice 7 is provided for direct connection of the hook of a sling or other interfaces (optional).

Figure 17:
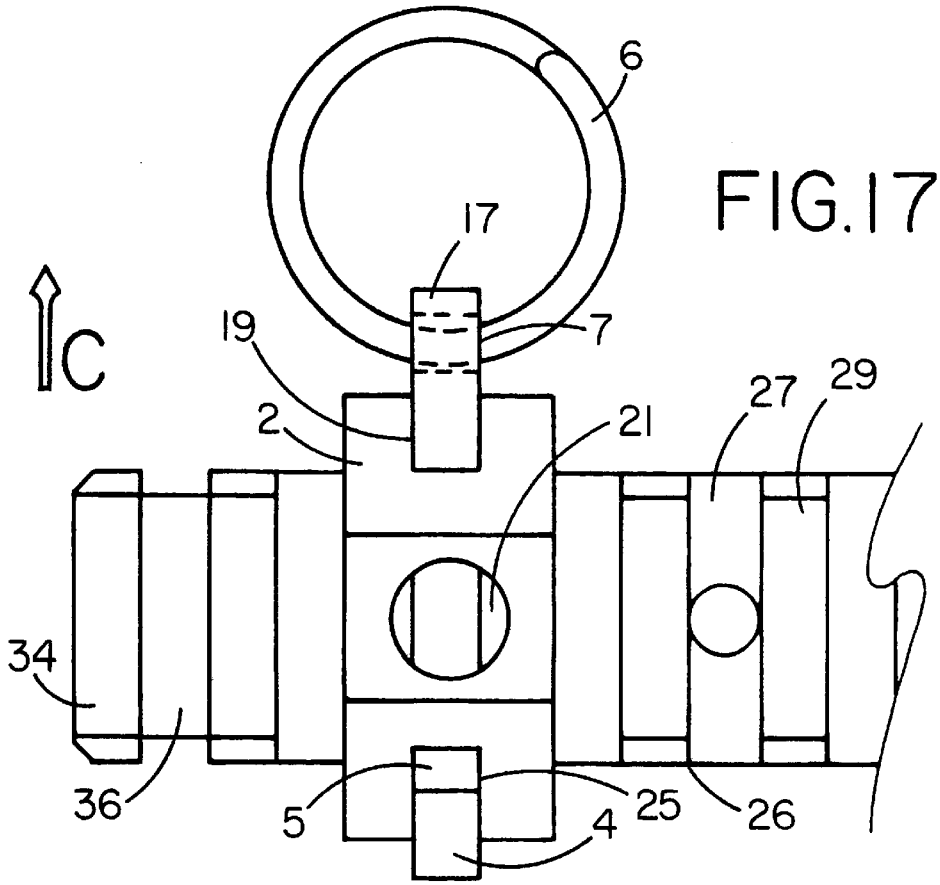
FIG. 17 is a side view of a rail of the RAS of the M4 Carbine showing the preferred embodiment (front mount) installed, base fixed and wedge locked with optional split ring attached (Step 4)

FIG. 17 shows the preferred embodiment (front mount) with base 2 fixed to rail 26 by wedge 4 and an additional interface in the form of a split ring 6. It can be seen that even if wedge 4 loosens it cannot be detached from rail 26 or base 2 due to an interference between small end of slot 19 and split ring 6. When force is applied in the direction of arrow "C" via split ring 6, wedge 4 returns to its fixed state tightly securing base 2 to rail 26. The assembly is therefore self tightening.

Figure 18:
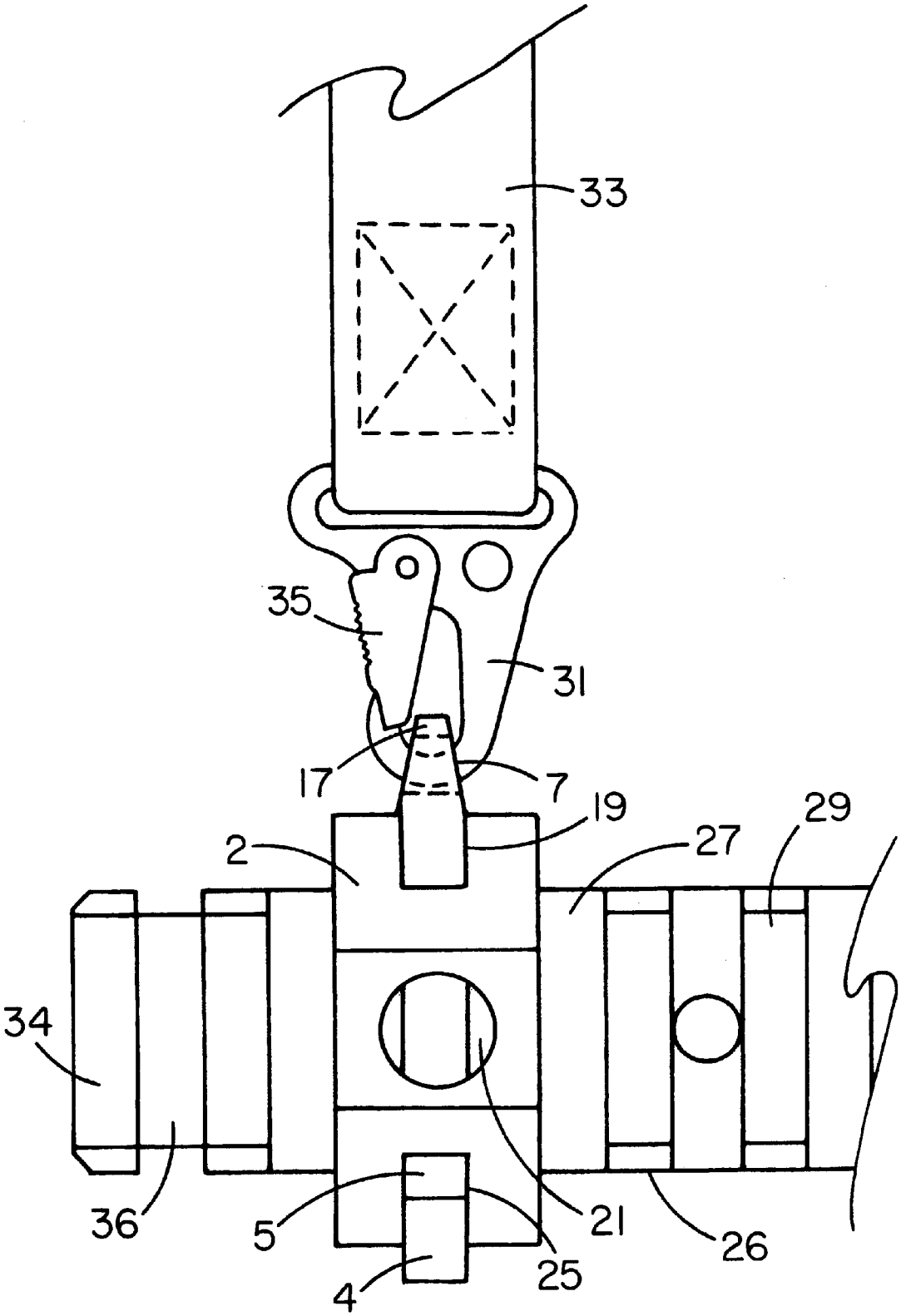
FIG. 18 is a side view of a rail of the RAS of the M4 Carbine showing the preferred embodiment (front mount) installed, base fixed and wedge (modified) locked with tactical sling hook directly attached.

FIG. 18 shows a modified wedge 4 securing base 2 to rail 26 where the leading end 17 of wedge 4 has been tapered to accept a hook 31 of a sling 33 through orifice 7 of wedge 4. A latch 35 of hook 31 is spring loaded and can be depressed to allow for insertion or removal of hook 31 into orifice 7 of wedge 4.

Figure 19:
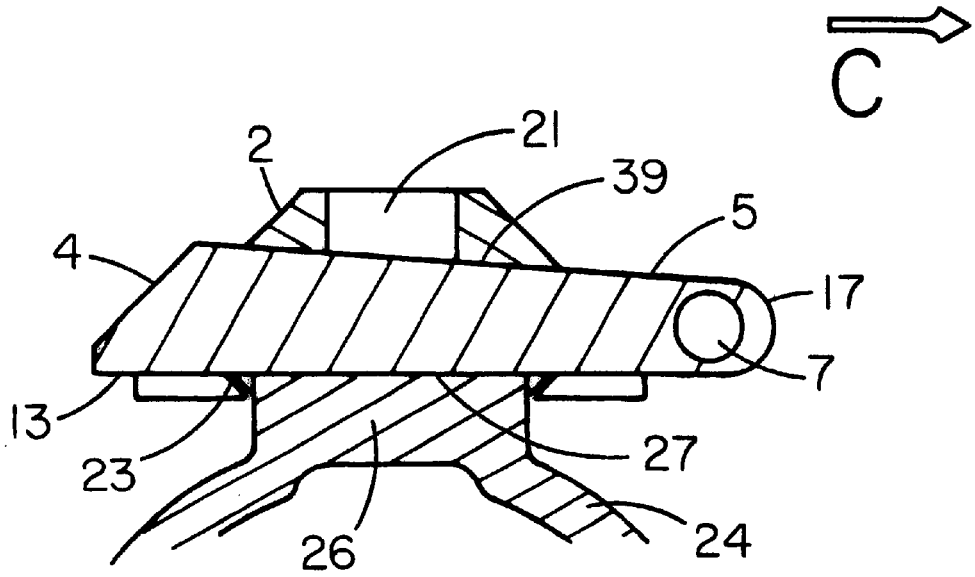
FIG. 19 is a partial cross-section view taken along line 19—19 of FIG. 1, showing the preferred embodiment attached to the RAS rail.

FIG. 19 shows the locking relationship of wedge 4 with rail 26 and base 2. A bottom 13 of wedge 4 runs along standard recess 27 in the direction of arrow "C" until slope edge 5 of wedge 4 interferes with a sloping slot 39 of base 2. This action forces base 2 away from rail 26 causing dovetail 23 to engage rail 26 securely.

Figure 20:
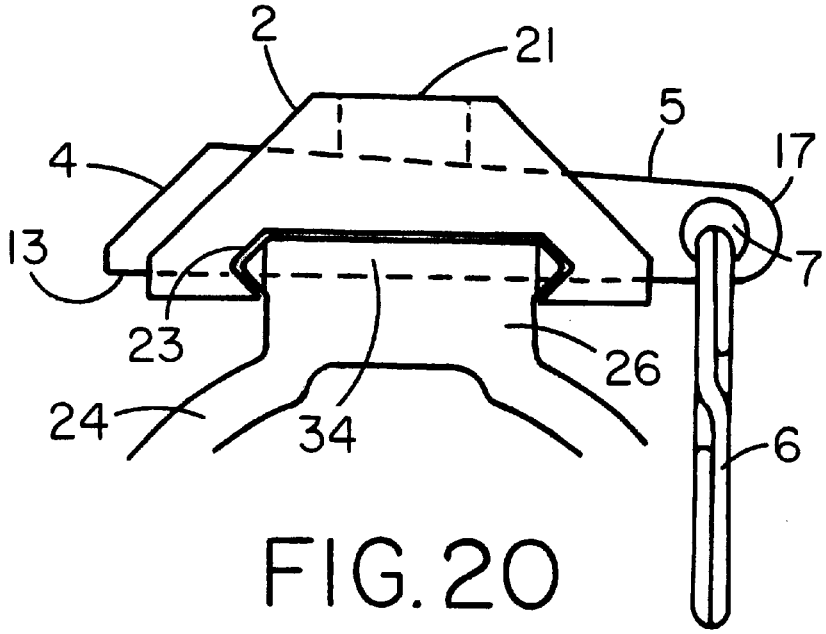
FIG. 20 is a end view of a rail of the RAS of the M4 Carbine showing the preferred embodiment (front mount) installed, base fixed and wedge locked with optional split ring attached.

FIG. 20 shows base 2 locked into position on rail 26 by wedge 4 with an interface in the form of split ring 6 attached to wedge 4 through orifice 7.

While the description above contains many specificities, these should not be construed as limitations on the scope of the invention, but rather as an exemplification of one preferred embodiment thereof Many other variations are possible.

Summary

It should, therefore, be clear to the reader that the structure of our invention will enable individuals to remove and install sling attachment hardware to firearms like the M4 Carbine quickly and efficiently without the use of tools. Furthermore, the structure of our invention has additional advantages in that;

- it is readily adaptable to a wide range of tactical slings;
- it has no screws or other mounting hardware that can shoot loose rendering the sling useless to the user;
- when properly installed, the mounting points are fixed and will not shift;
- the rear mount is rotational, making it ambidextrous, providing unhindered access to controls such as the charging handle,
- the front mount is self-tightening and cannot be inadvertently removed from the weapon;
- it can be configured for both right and left handed users;
- it allows for removal of the buttstock to access battery storage with the weapon slung;
- it can be configured to place the mounting points close to the receiver and torso of the user freeing-up the ends of the weapon, offering the user more mobility in CQB environments;
- lastly, the design of our sling attachment hardware provides for the proper balance of the weapon.

We claim:

1. Hardware for attaching a sling to a firearm, comprising:

Two interconnecting semi-circular ring halves with ends that extend more than 180°;

said ends having one or more tooth/slot configurations that, when joined, produce a complete ring;

a circular loop projecting from one or more of said ring halves configured to allow for rotational attachment of a sling to said firearm.

2. Hardware according to claim 1, wherein said ring halves include a groove to allow for attachment of a semi-circular spring clip to keep said ring halves in alignment and joined.

3. Hardware according to claim 1, wherein one or more of said ring halves include a slot for directly inserting/attaching a sling having a strap configuration that will not fit through said loop, said slot eliminating the need for additional hardware to attach said sling to said ring halves.

4. Hardware according to claim 2, wherein said semi-circular spring clip is configured to keep said ring halves permanently in alignment and joined.

5. Hardware according to claim 1, wherein one or more of said ring halves includes a means to limit rotation.

* * * * *